United States Patent [19]

Peterson

[11] Patent Number: 4,991,738

[45] Date of Patent: Feb. 12, 1991

[54] BEAUTICIAN'S DISPENSER OF FOIL SHEETS, AND METHOD OF DISPENSING

[76] Inventor: Natalie Peterson, P.O. Box 1296, Escondido, Calif. 92025

[21] Appl. No.: 242,710

[22] Filed: Sep. 9, 1988

[51] Int. Cl.[5] ..... B65H 3/20

[52] U.S. Cl. ..... 221/1; 221/124; 221/210

[58] Field of Search ..... 221/34, 36, 37, 185, 221/210, 259, 1, 124; 294/1.1

[56] References Cited

U.S. PATENT DOCUMENTS

| | | | |
|---|---|---|---|
| 1,357,070 | 10/1920 | Matthews | 221/43 X |
| 2,032,150 | 2/1936 | Richardson | 221/210 X |
| 2,072,757 | 3/1937 | Landsiedel | 221/34 |
| 3,094,323 | 6/1963 | Catania | 221/210 X |
| 4,401,233 | 8/1983 | Frey | 221/185 X |
| 4,417,670 | 11/1983 | Booher | 221/210 |
| 4,600,227 | 7/1986 | Ennis et al. | 294/1.1 |

*Primary Examiner*—F. J. Bartuska
*Attorney, Agent, or Firm*—Dressler, Goldsmith

[57] ABSTRACT

Thin sheets of metal foil are dispensed one-sheet-at-a-time by a dispenser. Differentially-sized stacks of foil sheets are held in correspondingly sized open-top reservoirs in a container. Removable paddles fit within the open tops of the container's reservoirs. The paddles have contact adhesive, typically non-drying electrician's clay, on their underside surfaces. The uppermost foil sheets within the reservoirs adhere to the paddles. Each paddle and its adhered foil sheet is extracted from the container, turned over, and maneuvered, foil sheet uppermost, into position below a lock of a subject's hair. In this position the hair lock is treated, typically by brushing with liquid hair coloring, while the foil sheet pools the liquid in contact with the hair. The thin foil sheet is peeled from its paddle carrier and folded around the hair lock. The treatment liquid is maintained in contact with the hair lock by the folded foil sheet. Each paddle is replaced upon its corresponding reservoir in order to adhere and to deliver successive foil sheets into the hair treatment process.

26 Claims, 2 Drawing Sheets

BEAUTICIAN'S DISPENSER OF FOIL SHEETS, AND METHOD OF DISPENSING

BACKGROUND OF THE INVENTION

1. Field of the Invention

The present invention concerns one-sheet-at-a-time dispensers of thin sheets, particularly foil sheets usable by beauticians. The present invention also concerns the use of thin foil sheets for applying and holding liquid hair coloring solution in contact with the hair of the head.

2. Background of the Invention

Many color treatments for the hair of both men and women require a selective application of liquid hair coloring solution in contact with regions of the hair. The selective application permits appropriate colors, hues, shades, tints, tinges, color densities, and/or color gradients to be realized in the hair.

One previous method of selectively applying hair coloring solution to regions of the hair is directed to producing a gradient of color, from lighter to darker (and vice versa), across the hair of the head. This common effect produces, especially in a thick and substantial head of hair, lightened regions which blend gradually into darker regions (and vice versa). The range of colors and color intensities, so obtained highlight the face and tastefully create an interesting appearance to the hair. In a similar manner hair tints and shades are often applied regionally and in gradual progressions to the hair, and not in a gross and uniform manner to an entire head of hair.

A typical process of selectively applying hair coloring solution to regions of the hair begins in the temple area. Beginning at this region strands of hair are woven out of very thin horizontal partings. These strands of hair are then placed on foil sheets and painted with a liquid hair coloring solution The process typically proceeds directionally toward the rear of the ear and toward the nape of the neck. A skilled beautician, or hair colorist, is able to use this process to good effect in order to color and tint the hair in a graduated and aesthetically pleasing manner.

Despite the visual appeal, and prevalence, of this selective, progressive, hair coloring procedure, the mechanics of performing the procedure are quite cumbersome and difficult. In particular, the repetitive positioning of the foil sheets below the strands of hair that are woven from the thin horizontal partings is both difficult and time consuming. The foil sheets must be accurately positioned below the hair strands in order that the liquid hair coloring solution may be applied at an appropriate concentration to such strands. The coloring solution is also desirably maintained in contact with the hair strands for a prolonged time duration after its initial application. In order to realize this prolonged contact the foil sheets must be left attached, such as by hair clips or other means, to the hair strands and to the individual hair partings. The foil sheets isolate and contain each individual parting, on to the next. Meanwhile, any contact of the hair coloring solution with the scalp and neck is desirably avoided because the solution may potentially stain the flesh These multiple requirements generally dictate that the positioning, and positional maintenance, of the foils is an intricate procedure that is best performed only by skilled beauticians.

Some beauticians have, impromptu, developed an improved procedure for the positioning and for the positional maintenance of the foil sheets. In this improved procedure each foil sheet is manually laid upon a planar sheet of cardboard that is of complimentary size and shape to the size and shape of the foil sheet, typically a 5"×8" rectangle. Each foil sheet is typically maintained upon the cardboard by folding it over one edge of the cardboard. The lock of hair is then maneuvered onto the top of the foil sheet while it is positioned upon the cardboard. The lock of hair is treated with the liquid hair coloring solution. Finally, the foil sheet is folded up and away from the cardboard and around the wetted lock of hair. It is thereafter maintained in position encapsulating the lock of hair while the coloring solution wets the lock of hair and until the hair coloring process is completed. The entire process typically lasts some portion of an hour in accordance with the directions of the manufacturer of the hair coloring solution.

This previous cardboard-assisted procedure for maneuvering successive foil sheets into proximity with the successive locks of hair in order to apply liquid hair coloring solution to these locks has proven superior to the use of foil sheets unsupported by cardboard, but is still time consuming and cumbersome. Particularly, the beautician must pause between the application of each successive foil sheet, of which many dozens are used in precisely graduated hair coloring treatments, in order to position a new foil sheet upon the cardboard's surface. Additionally, saturable cardboard often gets wet and consequently suffers degradation in its structural strength when it occasionally comes into contact with the hair coloring solution In addition, cardboard is not a sanitary medium, and is normally not sterilized.

Accordingly, it would be desirable if some improved apparatus and method for successively delivering successive foil sheets to the locks of the hair of the head could be derived. The improved apparatus and method would preferably both expedite and improve the process of administering hair coloring solution to locks of hair.

SUMMARY OF THE INVENTION

The present invention is embodied in a one-sheet-at-a-time dispenser of thin flexible sheets. The preferred embodiment of the dispenser dispenses liquid-impervious thin sheets, typically made of metal foil, that are sized and adapted to be manually folded around locks of hair in order to maintain liquids in contact with such hair locks. The present invention is additionally embodied in a method of dispensing thin flexible sheets one-sheet-at-a-time from a dispenser, and further in a method of using dispensed liquid-impervious flexible sheets to hold liquid hair coloring solution in contact with the hair.

The one-sheet-at-a-time dispenser of thin flexible sheets in accordance with the present invention includes a container having an open-top reservoir that holds a horizontally stacked plurality of thin flexible sheets. A removable paddle, shaped and adapted so that it fits within the open top to the container's reservoir, contacts an uppermost one of the plurality of thin sheets stacked therein. Contact adhesive is attached to the underside of the paddle. The contact adhesive affixes an uppermost one of the plurality of thin sheets to the paddle when the paddle is stowed within the container's reservoir.

When the paddle is manually grasped between the fingers and withdrawn from the container's reservoir then it extracts an uppermost one of the plurality of stacked thin sheets from the reservoir. The paddle is then turned over in order to position the adhesively affixed sheet uppermost, and is maneuvered to position and to hold the sheet below a lock of hair while hair coloring solution is applied. Finally, the thin sheet is peeled away from its removable adhesive affixation to the paddle, and is wrapped around the wetted lock of hair, encapsulating it. The paddle is thereafter referred to the open top of the container's reservoir to deliver a next, successive, uppermost sheet from the reservoir to a next successive lock of hair.

In one preferred embodiment of the dispenser, the container defines a plurality of differentially-sized reservoirs. Each reservoir holds a stacked plurality of respectively differentially-sized thin flexible sheets. A corresponding plurality of differentially-sized paddles fit within the differentially-sized reservoirs. The contact adhesive upon each of the paddles is typically a non-drying electrician's clay. The thin flexible sheets are typically metal foils, particularly aluminum foils.

The dispensing method in accordance with the present invention commences with the stacking of a plurality of thin flexible sheets substantially flat within an open-top reservoir, normally of complimentary size and shape to the stacked sheets, within a container. A paddle bearing contact adhesive upon its underside surface is pressed downwards against the uppermost one of the stacked plurality of thin sheets, releasably adhesively affixing this uppermost one sheet to the paddle. The paddle is then lifted off the stacked plurality of sheets, thereby removing the adhesively attached uppermost one sheet. The paddle is turned over so that the thin flexible sheet is uppermost. Finally, the sheet is manually peeled off the paddle, breaking its releasable adhesive affixation to the paddle.

The preferred dispensing method may be expanded for holding liquid hair coloring solution in contact with the hair of the head. In the expanded method the thin flexible sheet located uppermost upon the paddle is positioned under a lock of hair. A hair coloring solution is applied. The sheet is then folded about the lock of hair and peeled off the paddle (in either order).

The apparatus and methods of the present invention promote rapid, precise, and efficient delivery of successive thin flexible sheets to locks of the hair. This delivery supports the application of hair coloring solution to such locks. A beautician may pick up successive sheets, as desired, by the simple procedure of momentarily placing the paddle, adhesive side down, upon the stack of sheets within the container and then withdrawing the paddle. Due to the ease of this operation the beautician may concentrate on applying coloring or other liquid solutions to the hair. The beautician need not distract his/her attention from the client's head in order to prepare and position the successive foil sheets that are used in the hair coloring process.

DESCRIPTION OF THE PREFERRED EMBODIMENT

Figure 1:
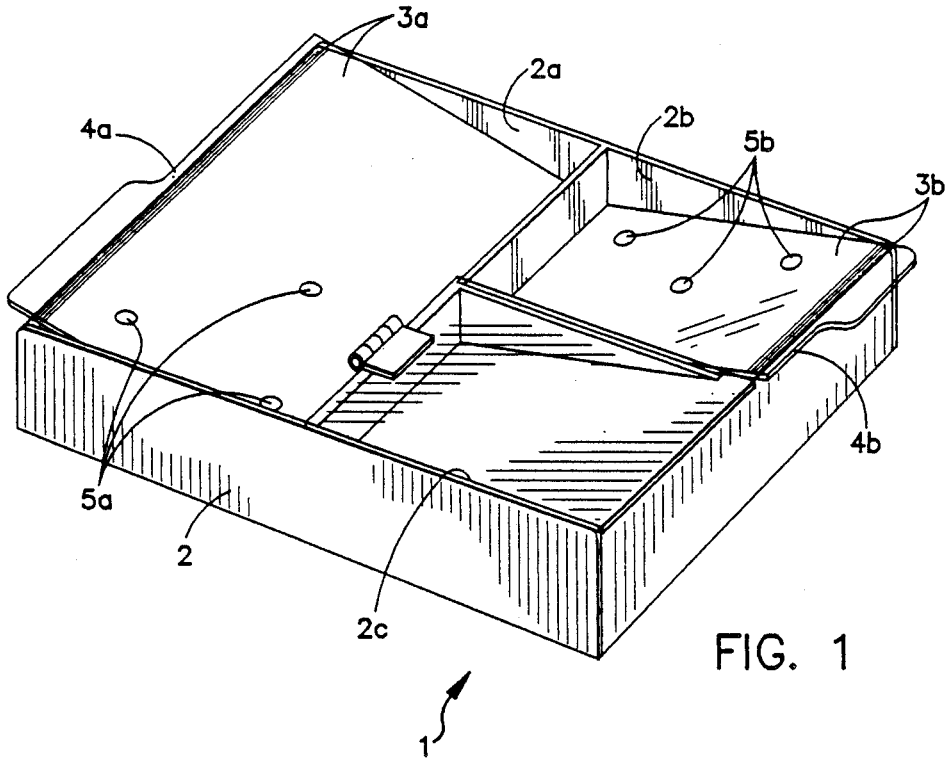
FIG. 1 is a perspective view showing a thin flexible sheet dispenser apparatus, particularly for use by beauticians, in accordance with the present invention.

A preferred embodiment of a one-sheet-at-a-time dispenser of thin sheets in accordance with the present invention is shown in perspective view in FIG. 1. The dispenser 1 is particularly useful for dispensing liquid-impervious thin flexible sheets that are sized and adapted so as to ultimately manually fold about wetted locks of the hair of the head in order to maintain liquids in contact with such hair locks. The preferred embodiment of the dispenser 1 is thus primarily usable by a beautician, although it may be used for the dispensing of thin flexible sheets in diverse applications.

The dispenser 1 includes a container 2 that is substantially in the shape of a rectangular box, as shown. The container 2 is typically made from plastic The container 2 is typically divided into a plurality of differentially-sized compartments, for example into illustrated compartments 2*a*–2*c*. Each compartment 2*a*–2*c* typically, although not necessarily, presents a slanted bottom (as is most clearly visible in FIG. 5). The slanted bottom proceeds from a central trough that is normally as deep as, or nearly as deep as, the entire depth of container 2 to the upper side edges of the sides of the container 2. The outer side lips of the container where each slanted bottom contacts a side upper edge are typically rounded, or beveled.

One or more of the compartments 2*a*–2*c*, for example compartments 2*a* and 2*b*, each independently individually contain a stack of flexible thin sheets that are typically of complimentary size and shape to the compartment. For example, compartments 2*a*, 2*b* are illustrated to respectively contain stacks of thin flexible sheets 3*a*, 3*b*. The thin flexible sheets within the stacks 3*a*, 3*b* are typically metal, and more typically aluminum, foil of several mils thickness. The thin flexible sheets in stacks 3*a*, 3*b* are typically initially stacked approximately 50 deep in each of the respective compartments 2*a*, 2*b*.

Each of the compartments 2*a*, 2*b* respectively containing the stacks of thin flexible sheets 3*a*, 3*b* also fits, as an uppermost lid, or cover, to such compartment a paddle 4*a*, 4*b*. The paddles 4*a*, 4*b* are typically simple plates made from plastic. The paddles 4*a*, 4*b* normally attach handles, typically as integral extensions to the plates.

The paddles 4*a*, 4*b* are of substantially complimentary size and shape to the compartments 2*a*, 2*b* into which they respectably fit. When laid within the open tops to compartments 2*a*, 2*b*, the paddles 4*a*, 4*b* form a detachable lid, or cover, to such compartment Each paddle 4*a*, 4*b* also presents an extension, or tab, that extends beyond the areas of respective compartment 2*a*, 2*b* and beyond the arms of the stacks of thin flexible sheets 3*a*, 3*b*. Each extension forms a handle, graspable between the fingers, to the flat surface of the paddles 4*a*, 4*b*.

Each of the paddles 4*a*, 4*b* mounts on its underside surface a respective area of contact adhesive 5*a*, 5*b*. Each area of contact adhesive 5*a*, 5*b* is typically not disposed over the entire underside surface of its respective paddle 4a, 4b. Rather, each area of contact adhesive 5a, 5b is typically formed as an array of dots (as illustrated). Each dot array areas of contact adhesive 5a, 5b is typically asymmetrically disposed upon the underside surface of its respective paddle 4a, 4b.

The contact adhesive 5a, 5b is typically clay, and more typically a non-drying electrician's clay. The clay is normally applied in small dots, approximately ⅛" in diameter, that are located substantially within one-half (only) of the area of the underside surfaces of paddles 4a, 4b. In their arrayed locations the dots of contact adhesive 5a, 5b will be adequately strong so as to adhesively affix an uppermost one of the stacked flexible sheets 3a, 3b to a paddle 4a, 4b and withdraw such uppermost one sheet from the reservoirs 2a, 2b of container 2. The contact adhesive 5a, 5b will, however, not be so extensive nor so strong so as to later make it difficult to fold, and to detach, the extracted uppermost one flexible sheet.

Figure 2:
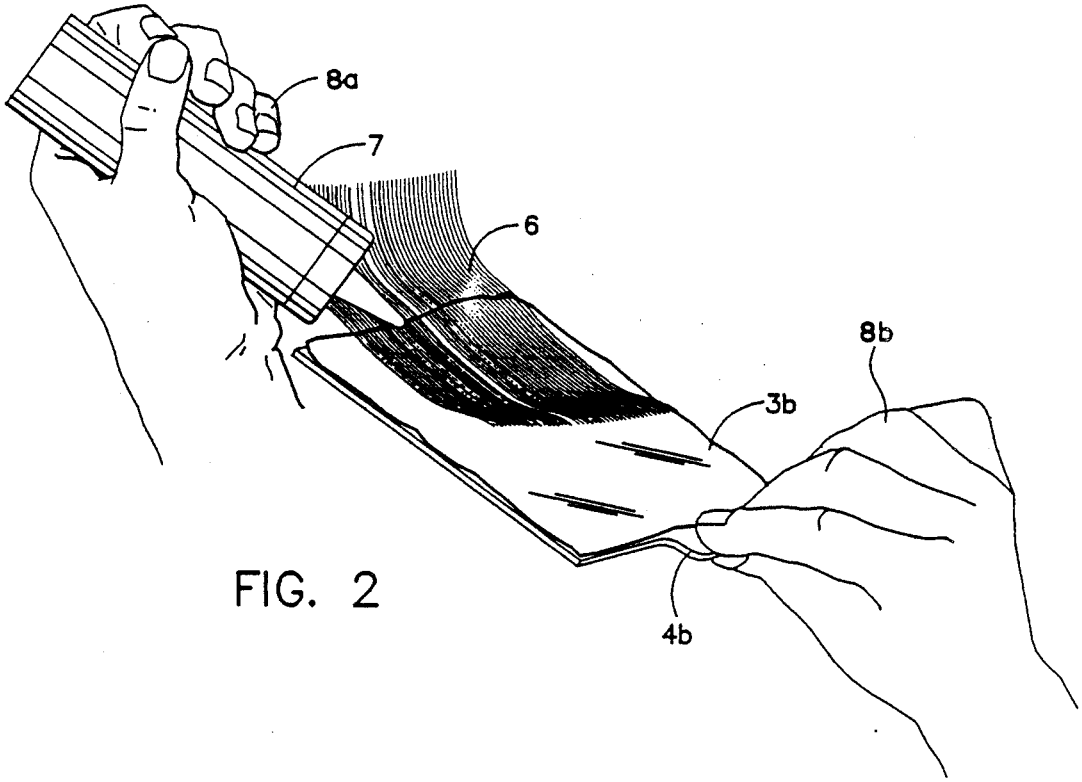
FIG. 2 is a diagrammatic illustration of the method of the present invention wherein a thin flexible sheet that is removably adhesively affixed to a paddle is positioned under a lock of the hair of the head in order that hair coloring or other liquid solution may be applied to the lock of hair while being constrained from dripping by the sheet.

The appearance of a paddle, and also of a thin flexible sheet removably adhesively affixed to such paddle after being extracted from the dispenser 1 (shown in FIG. 1), is shown in FIG. 2. A paddle, by example paddle 4b, affixing a thin flexible sheet, by example thin flexible sheet 3b, is held between the fingers of first hand 8a (shown in phantom line). While the flexible thin sheet 3b is held uppermost upon the paddle 4b it is positioned below a lock of hair 6 (shown in phantom line), which lock of hair 6 will be understood to still be attached to a subject's head (not shown).

While the lock of hair 6 is supported in position upon the surface of flexible sheet 3b a liquid solution is applied. The liquid solution is typically so applied by actuating squeeze bottle 7 (shown in phantom line) with the second hand 8b (also shown in phantom line). The liquid solution (not shown), normally hair coloring solution, that is typically brushed onto the lock of hair 6 from the mouth of squeeze bottle 7 flows upon the surface of flexible sheet 3b and wets the lock of hair 6. At the conclusion of applying so much of the liquid solution (not shown) to the lock of hair 6 as is desired, the flexible thin sheet 3b is normally folded up and around the lock of hair 6. Meanwhile the paddle 4b remains held in position by first hand 8a.

A continued adhesive holding of flexible sheet 3b on the paddle 4b even after it is folded about the lock of hair 6 is facilitated by the typically asymmetric location of the contact adhesive 5b (shown in FIG. 1). Normally the contact adhesive 5b is positioned on paddle 4b so that it remains contacting, and adhesively affixing, flexible sheet 3b even while the sheet is partially folded upwards into position surrounding the lock of hair 6. As soon as the lock of hair 6 is folded within an envelope that is formed from flexible sheet 3b to the satisfaction of the beautician (the possessor of hands 8a, 8b) then the paddle 4b is pulled away. The flexible sheet 3b is left in position substantially encapsulating the wetted lock of hair 6. The flexible sheet 3b is normally left in this position about the lock of hair 6, and upon the hair of the subject (not shown) until the hair coloring solution has had adequate time to take effect in accordance with the manufacturer's directions.

At the conclusion of delivering flexible sheet 3b by means of paddle 4b into its position encapsulating lock of hair 6, the paddle 4b is returned to its pick-up position at the top of the reservoir 2b of container 2 of dispenser 1 (shown in FIG. 1). By successive extractions of uppermost stacked ones of the liquid-impervious thin flexible sheets 3a, 3b by respective use of with the paddles 4a, 4b, both sizes of sheets 3a, 3b may be effectively and efficiently delivered to locks of hair for use in a hair coloring process.

Figure 3:
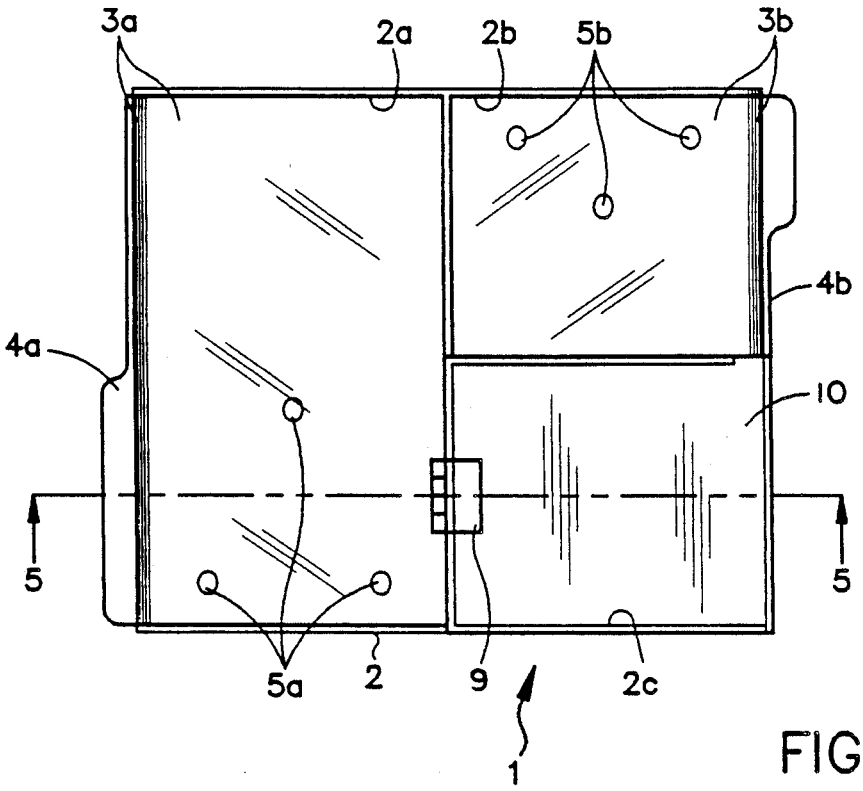
FIG. 3 is a top plan view showing the dispenser apparatus in accordance with the present invention.
Figure 4:
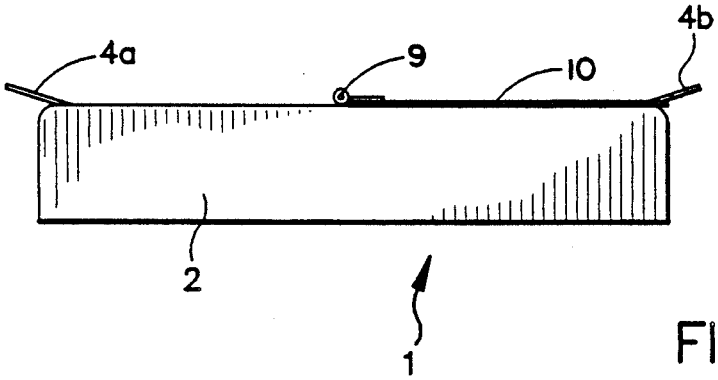
FIG. 4 is a side view showing the dispenser apparatus in accordance with the present invention.

A top plan view of the preferred embodiment of the dispenser 1 in accordance with the present invention is shown in FIG. 3. Each of the paddles 4a, 4b fits over a corresponding stack of flexible thin sheets 3a, 3b within the respective reservoirs 2a, 2b of the container 2. The container 2 is typically made of molded plastic. The paddles 4a, 4b are typically cut from clear acrylic plastic sheet of typical ¼" thickness. The paddles 4a, 4b present extensions, or tabs, in order to facilitate that they may be grasped and held between the fingers (as shown in FIG. 2). The paddles 4a, 4b are typically transparent. Thus the contact adhesive areas 5a, 5b are visible on the underside of the respective paddles 4a, 4b.

A third reservoir 2c to the container 2 does not normally contain flexible thin sheets. It is typically rather a generalized water-tight storage compartment that may be used to store solutions used in hair dressing, clips, bobbypins, and the like. It is typically equipped with a transparent cover 10 that is hinged for pivoting by hinge 9. The construction of the hinge 9 may be observed in the cross-sectional view of FIG. 5, taken along aspect line 5—5 shown in FIG. 3. The hinge 9 does not interfere with the successive removals and replacements of paddles 4a, 4b.

Figure 5:
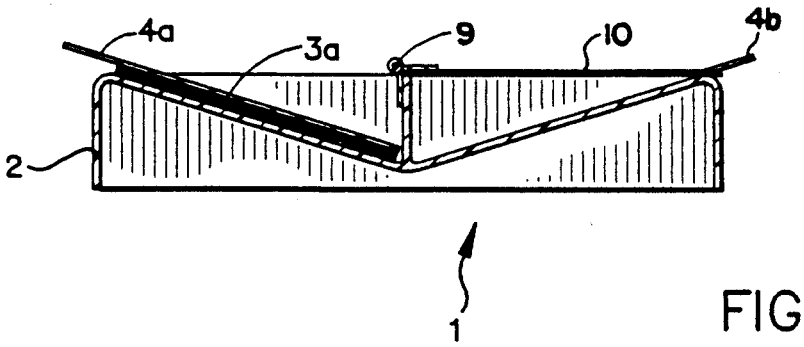
FIG. 5 is a cut away side view, taken along aspect line 5—5 shown in FIG. 3, showing the dispenser apparatus in accordance with the present invention.

The paddle 4a may be observed in FIG. 5 to lie at a slant that is substantially created by the tilted bottom to the reservoir 2a of the container 2. The paddle 4a lies upon the top of similarly slanted stacked flexible sheets 3a. The paddle 4b fits within the top of reservoir 2b of container 2 upon the slanted stack of flexible sheets 3b in a like manner (not shown). The slants to the stacked flexible sheets 3a, 3b, and to the paddles 4a, 4b when positioned in reservoirs 2a, 2b, help to maintain all components in alignment and in good order, making that spillage of stacked flexible sheets 3a, 3b is minimal.

The entire dispenser 1 in all of its components is susceptible of sterilization. The thin flexible sheets 3a, 3b are normally disposable and are not reused. The container 2 and paddles 4a, 4b are typically made of hard, high lustre, plastic that cleans reliably and easily with soap and hot water. Especially when the container 2 is black in color, the paddles 4a, 4b and the cover 10 are transparent, and the stacked thin flexible sheets 3a, 3b are natural aluminum metallic color, the entire dispenser 1 presents an aesthetically excellent appearance that is suitable for use in the finest salons and homes.

In accordance with the preceding explanation, certain variations and adaptations of the present invention will be perceived to be possible. The numbers of reservoirs, differentially-sized reservoirs, and differentially-sized sheets that fit within such reservoirs could each be varied. The flexible thin sheets that are stacked within such reservoirs could be urged to the top regions of such reservoirs by moving, spring-loaded, bottoms to such reservoirs. Such bottoms would make the reservoirs similar to reservoirs dispensing dishes.

The entire container 2 need not have presented the flexible thin sheets stacked therein in a slightly slanted and/or in a substantially horizontal array, but could have instead held and presented the flexible thin sheets in a multi-level tiered vertical structure. Such a tiered vertical structure could resemble the common in and out baskets upon an office desk.

The extensions, or tabs, by which the paddles are grasped could be alternatively configured, and could even be configured as contoured handles, if desired.

The contact adhesive by which the flexible sheets are temporarily adhered to the paddles could be more extensively and/or symmetrically arrayed upon the underside surfaces of the paddles, or could even be continuous over such surfaces.

Once the method of the present invention for delivering an artifact, particularly a thin flexible sheet that is useful in the treatment of the hair, to the region of the hair by temporarily adhering such thin flexible sheet to a paddle sheet carrier is recognized, then substantial alterations in the method will be perceived to be possible. The artifacts that are successively delivered to the hair could be stacked conical, or frustaconical, shapes instead of thin flexible sheets. In this case the substantially planar paddle carrier would be replaced with a carrier substantially in the shape of a candle snuffer. Such a carrier would accord for the transport of non-planar artifacts from a reservoir of such artifacts to positions proximate locks of hair of the head, and for the subsequent release of such artifacts so as to remain in contact with the hair locks.

According to these and other possible variations and adaptations, the present invention should be interpreted broadly in accordance with the following claims, only, and not solely in accordance with that particular embodiment within which the invention has been taught.

What is claimed is:

1. A one-sheet-at-a-time dispenser of sheets comprising:

a container defining an open-topped reservoir for holding a stacked plurality of sheets;

a removable paddle means, shaped and adapted so that it will fit within the open top of the container's reservoir, (i) contacting when positioned within the open top of the container's reservoir an uppermost one of any plurality of sheets stacked therein over a substantial area of this uppermost sheet, (ii) transported without the container's reservoir for withdrawing this contacted uppermost sheet, and (iii) physically supporting, when spatially oriented in its transported position so as to place the withdrawn sheet uppermost, the withdrawn sheet over the substantial area thereof; and contact adhesive means, attached to the underside of the paddle as it fits within the container's reservoir, for releasably adhesively affixing the uppermost sheet stacked within the container's reservoir to the paddle upon such times as the paddle is transported from the container's reservoir, therein aiding the withdrawing of the uppermost sheet from the container's reservoir upon transportation of the paddle.

2. The dispenser according to claim 1;

wherein the container defines a plurality of differentially-sized reservoirs each for holding a stacked plurality of respectively differentially-sized sheets; wherein the transported paddle means comprises:

a plurality of differentially-sized paddles respectively contacting uppermost ones of the like plurality of any differentially-sized sheets that are stacked within respective ones of the plurality of differentially-sized reservoirs; and wherein the contact adhesive means comprises:

a plurality of contact adhesive areas attached to the underside of the plurality of paddles.

3. The dispenser according to claim 1 wherein the container defines at lease one additional reservoir that is fitted with a non-detachable top.

4. The dispenser according to claim 3 wherein the non-detachable top is hinged to selectively cover the at least one additional reservoir.

5. The dispenser according to claim 1 wherein the contact adhesive means are disposed on the underside of the paddle in positions permitting that the withdrawn sheet releasably affixed to the paddle may be folded over onto itself while still remaining so affixed and while still supported.

6. The dispenser according to claim 1 wherein the container's reservoir exhibits a bottom that is slanted relative to flat when the container is positioned upon a flat surface, the slanted reservoir bottom therein holding any plurality of sheets stacked within the reservoir at a slant in order to facilitate that sheets below the uppermost sheet remain neatly stacked upon such times as the uppermost sheet is withdrawn from the container by its adhesive affixation to the paddle.

7. The dispenser according to claim 1 wherein the paddle comprises:

a rectangular planar member, larger than any of the stacked plurality of sheets, presenting a tab that may be grasped and held by the hand and fingers without causing any interference with withdrawal from the reservoir of the uppermost sheet by its adhesive affixation to the paddle.

8. The dispenser according to claim 1 wherein the contact adhesive means comprises:

clay.

9. The dispenser according to claim 8 wherein the clay comprises:

non-drying electrician's clay.

10. The dispenser according to claim 1 further comprising:

a plurality of thin flexible sheets stacked within the container's reservoir.

11. The dispenser according to claim 10 wherein each of the plurality of thin flexible sheets comprises:

metal foil.

12. The dispenser according to claim 11 wherein the metal foil consists essentially of aluminum.

13. A method of dispensing sheets one at a time from a dispenser comprising:

stacking a plurality of sheets substantially flat within a open-topped reservoir of complementary configuration defined by and within a container of sheets;

pressing a paddle that bears contact adhesive upon an underside surface that is, in a paddle end region, substantially coextensive with a sheet, downwards against an uppermost one of the stacked plurality of sheets until the uppermost one sheet is releasably adhesively affixed to the paddle;

lifting the paddle, and the uppermost one sheet adhesively affixed thereto, from off the stacked plurality of sheets;

transporting the paddle and the sheet adhesively affixed thereto to a position remote from the reservoir, and no longer contacting the reservoir or any remaining ones of the stacked plurality of sheets;

turning the paddle over so that the one sheet adhesively affixed to the paddle is uppermost and is substantially supported on the paddle; and pulling the one sheet off the paddle and from the contact adhesive upon the surface of the paddle.

14. The dispensing method according to claim 13 that between the turning and the pulling further comprises:

folding the one of the plurality of sheets over against itself while in position disposed uppermost to the paddle to which it remains releasably adhesively affixed and supported.

15. A beautician's dispenser of liquid-impervious foil sheets sized and adapted to be manually folded around locks of hair in order to maintain a liquid applied to such hair locks in contact with the locks, the dispenser comprising:

a container defining an open-topped reservoir for holding a stacked plurality of foil sheets;

a detachable transportable removable paddle (i) fitting within the container's reservoir, (ii) making planar contact with, and substantially coextensive with area of, an uppermost one of the plurality of foil sheets stacked therein, (iii) presenting a feature graspable by the fingers at a region of the paddle peripheral to the region of planar contact, (iv) grasped between the fingers at its peripheral region and extracted from the container's reservoir and off the stacked plurality of foil sheets to a position remote therefrom in order to remove the uppermost one of the plurality of foil sheets from the stack and from the container's reservoir; and (v) turned over by the grasping fingers so that the removed and transported sheet is uppermost, and is supported over its substantial area by the paddle; and contact adhesive upon the planar surface of the paddle in positions where it makes planar contact with, and over the substantial area of, the uppermost one of the plurality of foil sheets.

16. The dispenser according to claim 15 wherein the container defines a plurality of differentially-sized reservoirs each for holding a stacked plurality of respectively differentially-sized sheets; wherein the extractable paddle comprises:

a plurality of differentially-sized paddles respectively contacting uppermost ones of the like plurality of any differentially-sized sheets that are stacked within respective ones of the plurality of differentially-sized reservoirs over the substantial areas thereof; and wherein the contact adhesive comprises:

a plurality of contact adhesive areas attached to the underside of the plurality of paddles.

17. The dispenser according to claim 15 wherein the container defines at least one additional reservoir that is fitted with a non-detachable top.

18. The dispenser according to claim 17 wherein the non-detachable top is hinged to selectively cover the at least one additional reservoir.

19. The dispenser according to claim 15 wherein the contact adhesive is disposed on the underside of the paddle in positions permitting that the uppermost one of the plurality of sheets releasably affixed to the paddle may be folded over onto itself while still remaining so affixed, and priorly that the sheet should be releasably separated from the contact adhesive means attached to the paddle.

20. The dispenser according to claim 15 wherein the container's reservoir exhibits a bottom that is slanted relative to flat when the container is positioned upon a flat surface, the slanted reservoir bottom therein holding any plurality of sheets stacked within the reservoir at a slant in order to facilitate that sheets below the uppermost one sheet remain neatly stacked upon such times as the uppermost one sheet is withdrawn from the container by adhesive affixation to the paddle.

21. The dispenser according to claim 15 wherein the paddle comprises:

a rectangular planar member, larger than any of the stacked plurality of sheets, presenting a tab that may be grasped and held by the hand and fingers without causing any interference with removal from the reservoir of a thin sheet by its adhesive affixation to the paddle.

22. The dispenser according to claim 15 wherein the contact adhesive comprises:

clay.

23. The dispenser according to claim 22 wherein the clay comprises:

non-drying electrician's clay.

24. The dispenser according to claim 15 further comprising:

a plurality of thin flexible sheets stacked within the container's reservoir.

25. The dispenser according to claim 24 wherein each of the plurality of thin flexible sheets comprises:

metal foil.

26. The dispenser according to claim 25 wherein the metal foil consists essentially of aluminum.

* * * * *